US007717686B2

(12) United States Patent
Kondo et al.

(10) Patent No.: US 7,717,686 B2
(45) Date of Patent: May 18, 2010

(54) TWO STAGE COMPRESSOR HAVING ROTARY AND SCROLL TYPE COMPRESSION MECHANISMS

(75) Inventors: Kazuya Kondo, Nagoya (JP); Hajime Sato, Nagoya (JP); Yoshiyuki Kimata, Kiyosu (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/250,697

(22) Filed: Oct. 14, 2008

(65) Prior Publication Data

US 2009/0104062 A1 Apr. 23, 2009

(30) Foreign Application Priority Data

Oct. 19, 2007 (JP) ..... 2007-272483

(51) Int. Cl.
*F01C 1/30* (2006.01)
*F03C 2/00* (2006.01)

(52) U.S. Cl. ..... 418/3; 418/11; 418/60; 418/65; 418/88; 418/94

(58) Field of Classification Search ..... 418/3, 418/11, 60, 63, 88, 96, 94, 58, 65
See application file for complete search history.

(56) References Cited

U.S. PATENT DOCUMENTS 7,419,369 B2 * 9/2008 Sakitani et al. ..... 418/3

FOREIGN PATENT DOCUMENTS

| | | | | |
|---|---|---|---|---|
| JP | 61079895 A | * | 4/1986 | ..... 418/63 |
| JP | 05-087074 A | | 4/1993 | |
| JP | 05195975 A | * | 8/1993 | ..... 418/63 |
| JP | 2000291552 A | * | 10/2000 | |

* cited by examiner

*Primary Examiner*—Theresa Trieu
(74) *Attorney, Agent, or Firm*—Westerman, Hattori, Daniels & Adrian, LLP

(57) ABSTRACT

There is provided a compressor capable of feeding lubricating oil to a blade of a rotary type compression mechanism even if the oil level in an oil reservoir lowers. The compressor includes a low stage-side rotary type compression mechanism having a rotor, and a blade reciprocating with the rotation of the rotor while the tip end thereof is in contact with the rotor; a high stage-side scroll type compression mechanism for sucking and compressing refrigerant gas compressed by the low stage-side rotary type compression mechanism; a positive displacement lubrication pump for feeding lubricating oil to the high stage-side scroll type compression mechanism; and an oil feeding path for feeding the lubricating oil, which is fed to the high stage-side scroll type compression mechanism, toward the blade of the low stage-side rotary type compression mechanism.

8 Claims, 6 Drawing Sheets

TWO STAGE COMPRESSOR HAVING ROTARY AND SCROLL TYPE COMPRESSION MECHANISMS

BACKGROUND OF THE INVENTION

1. Field of the Invention

The present invention relates to a compressor and, more particularly, to a compressor provided with two compression mechanisms of a rotary type compression mechanism and a scroll type compression mechanism.

2. Description of the Related Art

A compressor provided with two compression mechanisms of a rotary type compression mechanism and a scroll type compression mechanism has been proposed. For example, Japanese Patent Laid-Open No. 5-87074 discloses a two-stage compressor in which an electric motor is provided in a single hermetic housing and two compression mechanisms each driven by the rotating shaft of the electric motor are provided; one of these two compression mechanisms is made a rotary type compression mechanism and the other thereof is made a scroll type compression mechanism; and one of the two compression mechanisms is on the low stage side and the other thereof is on the high stage side. Japanese Patent Laid-Open No. 5-87074 describes that in this two-stage compressor, the low stage-side compression mechanism is preferably of a rotary type. According to this two-stage compressor, the low stage-side compressor compresses gases from a low pressure to an intermediate pressure, and the high stage-side compressor compresses gases from the intermediate pressure to a high pressure. Therefore, the drawback of individual compressor is overcome, and a compressor small in size but high in performance can be provided as compared with the case where a rotary type compression mechanism or a scroll type compression mechanism is used singly to compress gases from a lower pressure to a high pressure.

The rotary type compression mechanism has a rotor performing eccentric rotating motion in a cylinder and a blade reciprocating in a groove in the cylinder while the tip end thereof is in contact with the rotor. The blade partitions a space formed by the cylinder and the rotor into a suction chamber and a compression chamber. This blade must be lubricated because of its sliding motion performed when the blade reciprocates in the groove. Therefore, the oil level of lubricating oil is controlled so that the cylinder is immersed in the lubricating oil stored in an oil reservoir provided in the bottom part of the compressor.

From the viewpoint of energy saving, an inverter is used for the rotating speed control of a compressor. The inverter can be operated in a wide range from a low rotational speed to a high rotational speed. In the case of low rotational speed, the quantity of lubricating oil drawn up from the oil reservoir to lubricate the compression mechanisms is small, but in the case of high rotational speed, a large quantity of lubricating oil is drawn up. That is to say, the use of the inverter changes the height of oil level depending on the rotational speed of the compressor.

Also, in recent years, from the viewpoint of the preservation of global environment, the use of carbon dioxide ($CO_2$), which is one of natural refrigerants, as a refrigerant gas has been studied. If $CO_2$ is used as a refrigerant gas, the pressure on the high pressure side of a heat pump cycle increases and exceeds the critical pressure. If $CO_2$ in a supercritical pressure state is used, the dissolution amount of lubricating oil increases, so that the height of oil level is liable to change depending on the operating condition. In particular, in an operating condition in which the circulation amount of refrigerant gas is large, the quantity of lubricating oil in the oil reservoir decreases, and the oil level may become lower than the cylinder. At this time, the lubricating oil is not supplied to between the blade and the groove. Therefore, the mechanical efficiency is decreased by the increase in friction between the blade and the cylinder (groove), and also the reliability may be decreased by the friction. Also, the refrigerant gas flows in between the suction chambers or the compression chambers from the back surface of blade, which also poses a problem of decreased compressing efficiency.

SUMMARY OF THE INVENTION

The present invention has been accomplished to solve the above-described technical problems, and accordingly an object thereof is to provide a compressor capable of feeding lubricating oil to a blade of a rotary type compression mechanism even if the oil level in an oil reservoir lowers.

To achieve the above object, the present invention provides a compressor including a hermetic housing in which lubricating oil is stored in the bottom part thereof; a low stage-side rotary type compression mechanism provided in the hermetic housing and having a rotor, and a cylinder for holding the blade reciprocating with the rotation of the rotor while the tip end thereof is in contact with the rotor; a high stage-side scroll type compression mechanism provided in the hermetic housing to suck and compress refrigerant gas compressed by the low stage-side rotary type compression mechanism; a drive shaft connecting the low stage-side rotary type compression mechanism and the high stage-side scroll type compression mechanism to each other and having an oil feeding hole in the axial direction; an electric motor for driving the low stage-side rotary type compression mechanism and the high stage-side scroll type compression mechanism via the drive shaft; a lubrication pump for feeding the lubricating oil to the high stage-side scroll type compression mechanism via the oil feeding hole; and an oil feeding path for feeding the lubricating oil, which is fed to the high stage-side scroll type compression mechanism, toward the blade of the low stage-side rotary type compression mechanism.

The compressor in accordance with the present invention feeds the lubricating oil, which is drawn up by the lubrication pump and fed to the high stage-side scroll type compression mechanism during operation, toward the blade. Therefore, the compressor in accordance with the present invention can feed the lubricating oil to the blade surely even if the oil level in the oil reservoir lowers during operation.

In the compressor in accordance with the present invention, the oil feeding path is preferably configured so that the lubricating oil drops freely and is fed toward the blade. According to this oil feeding path, the lubricating oil fed to the high stage-side scroll type compression mechanism can be fed to the blade through the shortest distance. Therefore, the dissolution of lubricating oil in the refrigerant gas can be kept to the minimum. Also, according to this oil feeding path, a member for guiding the lubricating oil coming from the high stage-side scroll type compression mechanism to the blade need not be provided separately.

In the compressor in accordance with the present invention, the oil feeding path is preferably configured so that the lubricating oil is fed toward a penetrating hole formed in the cylinder so as to house an elastic body for pressing the blade toward the rotor and to penetrate in the rotation axis direction of the rotor. The lubricating oil fed toward the penetrating hole is sucked toward the tip end direction of the blade by the influence of differential pressure with the interior of rotor, so that the blade can be lubricated smoothly. Also, excess lubricating oil passes through the penetrating hole, and is dropped into the oil reservoir in the bottom part of the hermetic housing. Therefore, an increase in oil circulation rate (the quantity of oil circulating together with the refrigerant gas, OCR) caused by the raised excess lubricating oil can be prevented.

In the compressor in accordance with the present invention, the oil feeding path preferably has a shield for restraining the contact of the lubricating oil flowing in the oil feeding path with the refrigerant gas existing in the hermetic housing, so as to prevent an increase in OCR.

In the compressor in accordance with the present invention, in the case where the low stage-side rotary type compression mechanism is formed by a first rotary type compression mechanism positioned on the upper side and a second rotary type compression mechanism positioned on the lower side of the first rotary type compression mechanism, the oil feeding path has only to be configured so as to feed the lubricating oil, which is fed to the high stage-side scroll type compression mechanism, toward the blade of the first rotary type compression mechanism. For the second rotary type compression mechanism positioned on the lower side, the lubricating oil can be fed to the blade stably by adjusting the oil level of lubricating oil, but for the first rotary type compression mechanism positioned on the upper side, the lubricating oil cannot be fed stably. Therefore, the lubricating oil is fed from the high stage-side scroll type compression mechanism toward the blade of the first rotary type compression mechanism positioned on the upper side.

As described before, in the case where the refrigerant gas is $CO_2$, the dissolution amount of lubricating oil increases, so that the height of oil level is liable to change depending on the operating condition. Therefore, the present invention is preferably applied to a compressor in which $CO_2$ is used as the refrigerant gas.

According to the present invention, even if the oil level in the oil reservoir lowers during operation, the lubricating oil can be fed to the blade surely.

DETAILED DESCRIPTION OF THE PREFERRED EMBODIMENTS

First Embodiment

Embodiments of the present invention will now be described in detail with reference to the accompanying drawings.

Figure 1:
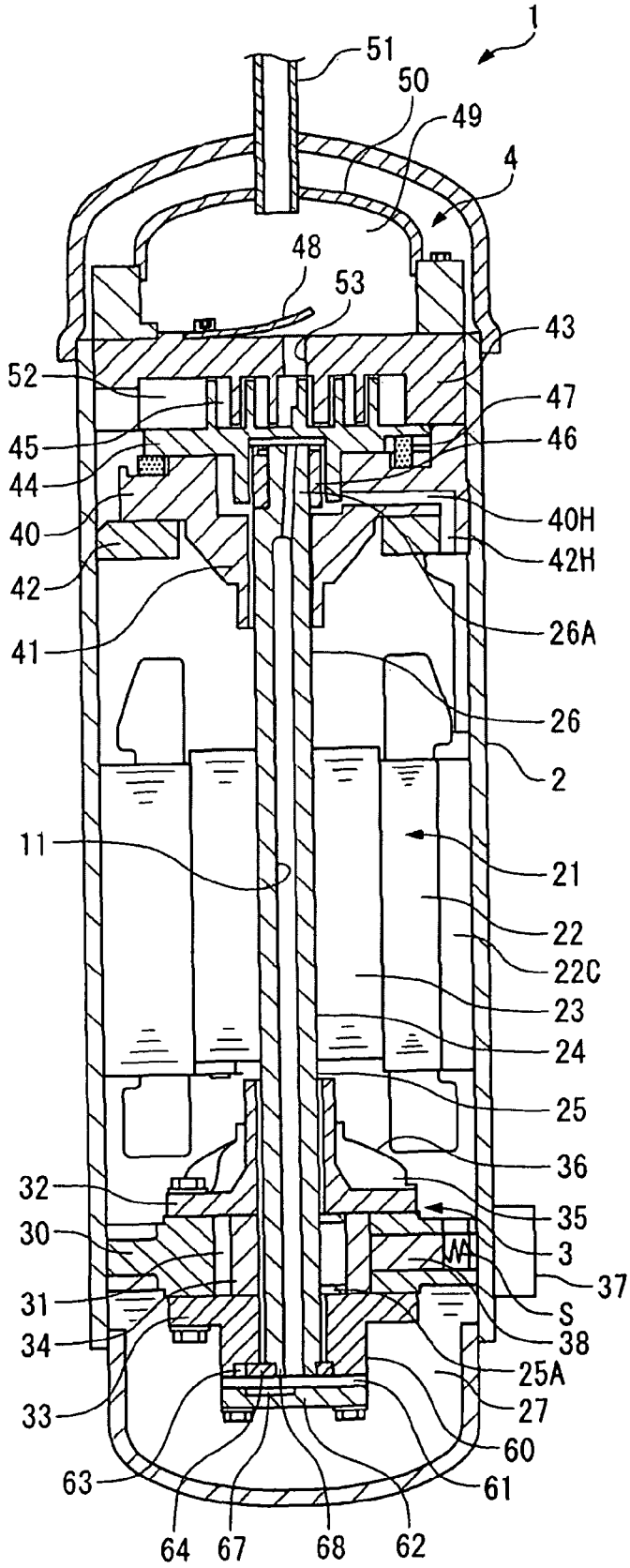
FIG. 1 is a sectional view showing a construction of a compressor to which the present invention is applied.

FIG. 1 is a sectional view showing the construction of a compressor 1 in accordance with a first embodiment.

In the compressor 1, a low stage-side rotary type compression mechanism 3 is provided in the lower part of a hermetic housing 2, and a high stage-side scroll type compression mechanism 4 is provided in the upper part therein. Also, in the central part of the hermetic housing 2, an electric motor 21 is provided between the low stage-side rotary type compression mechanism 3 and the high stage-side scroll type compression mechanism 4. The electric motor 21 includes a stator 22 and a rotor 23. The rotor 23 is integrally connected with a crankshaft 24. The lower end part of the crankshaft 24 forms a crankshaft 25 for the low stage-side rotary type compression mechanism 3, and the upper end part thereof forms a crankshaft 26 for the high stage-side scroll type compression mechanism 4. In the outer peripheral surface of the stator 22, cut parts 22C are formed. In portions in which the cut parts 22C are formed, spaces are formed between the stator 22 and the hermetic housing 2. Usually, the plurality of cut parts 22C are formed at predetermined intervals in the outer periphery direction of the stator 22.

Also, in the bottom part of the hermetic housing 2, a predetermined amount of lubricating oil 27 is stored. The lubricating oil 27 is fed to predetermined lubrication locations of the low stage-side rotary type compression mechanism 3 and the high stage-side scroll type compression mechanism 4 via an oil feeding hole 11 formed in the axial direction of the crankshaft 24 by a positive displacement lubrication pump 60 provided in the lower end part of the crankshaft 25.

Figure 2:
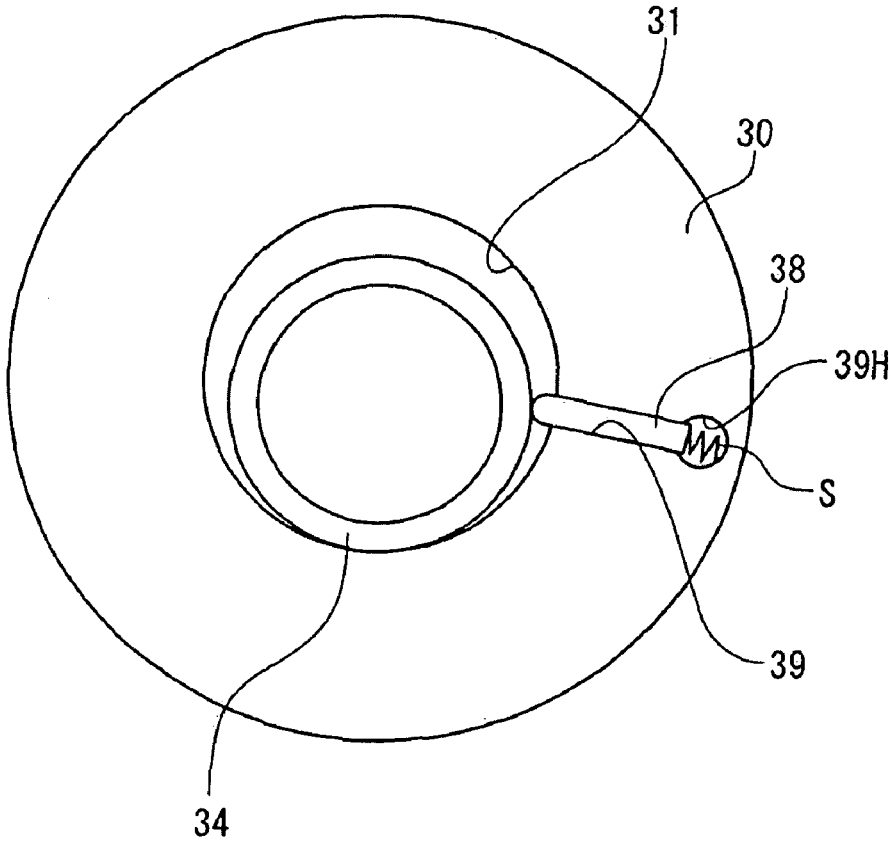
FIG. 2 is a plan view showing a construction of a rotary type compression mechanism on the low stage side.

As the low stage-side rotary type compression mechanism 3, a general rotary type compression mechanism is used which has a cylinder chamber 31, and includes a cylinder body 30 fixed to the hermetic housing 2, an upper bearing 32 and a lower bearing 33 provided on top of and beneath the cylinder body 30, respectively, a rotor 34 fitted in a crank part 25A of the crankshaft 25 and rotated slidingly in the cylinder chamber 31, a discharge cover 36 forming a discharge cavity 35, and a blade 38 (refer to FIG. 2) partitioning the cylinder chamber 31. As shown in FIG. 2, the blade 38 is disposed in a slit 39 formed in the cylinder body 30. The slit 39 is formed along the radial direction of the cylinder body 30 so as to have an approximately uniform width, and one end thereof is open to the cylinder chamber 31. At the other end of the slit 39, a broached hole 39H is formed. The broached hole 39H penetrates the cylinder body 30 in the rotation axis direction of the rotor 34. A spring S is disposed in the broached hole 39H to press the blade 38 toward the rotor 34. The blade 38 reciprocates along the radial direction with the rotation of the rotor 34 while the tip end thereof is in contact with the outer periphery of the rotor 34.

In the low stage-side rotary type compression mechanism 3, refrigerant gas sucked into the cylinder chamber 31 via a suction pipe 37 connected to an accumulator, not shown, is compressed to an intermediate pressure by the rotation of the rotor 34, and then is discharged into the discharge cavity 35 and is further discharged into the hermetic housing 2 through a discharge opening provided in the discharge cover 36.

The refrigerant gas having the intermediate pressure discharged into the hermetic housing 2 flows into an upper space of the hermetic housing 2 through an air gap and the like of the electric motor 21, and is sucked into the high stage-side scroll type compression mechanism 4.

The high stage-side scroll type compression mechanism 4 includes a bearing 40 having a bearing part 41 for supporting the crankshaft 26 from the outer periphery and a fixing plate 42 for fixing the bearing 40. The fixing plate 42 is fixed to the hermetic housing 2. The bearing 40 is formed with an oil exhaust hole 40H. The oil exhaust hole 40H is formed so as to be directed from the central part to the outer peripheral part of the bearing 40, and extends downward in the figure in the end part of the outer peripheral part. The fixing plate 42 is also formed with an oil exhaust hole 42H. The oil exhaust hole 42H is connected to the oil exhaust hole 40H. The lubricating oil 27 supplied to the high stage-side scroll type compression mechanism 4 as described later is collected in a concave part of the bearing 40, and is exhausted from this concave part to the lower part of the hermetic housing 2 through the oil exhaust hole 40H and the oil exhaust hole 42H.

For the compressor 1 in accordance with this embodiment, the positions of the oil exhaust hole 42H and the cut part 22C coincide with each other in the vertical direction. Further, the positions of the cut part 22C and the portion in which the blade 38 of the low stage-side rotary type compression mechanism 3 is disposed coincide with each other in the vertical direction. Therefore, the lubricating oil 27 exhausted from the oil exhaust hole 42H freely drops and passes through a space between the stator 22 and the hermetic housing 2, which is formed by the cut part 22C, and then is dripped toward the blade 38 of the low stage-side rotary type compression mechanism 3.

Also, the high stage-side scroll type compression mechanism 4 includes a fixed scroll 43 and an orbiting scroll 44 for forming a pair of compression chambers 45 by being engaged with each other with the phase being shifted, a drive bush 46 connecting the orbiting scroll 44 to a crank part 26A formed at the shaft end of the crankshaft 26 to revolve the orbiting scroll 44, and an Oldham's ring 47 provided between the orbiting scroll 44 and the bearing 40 to revolve the orbiting scroll 44 while preventing the rotation thereof.

Further, the high stage-side scroll type compression mechanism 4 includes a discharge valve 48 provided on the back surface of the fixed scroll 43 and a discharge cover 50 fixed on the back surface of the fixed scroll 43 to form a discharge chamber 49 between the discharge cover 50 and the fixed scroll 43.

In the high stage-side scroll type compression mechanism 4, a discharge pipe 51 is connected to the discharge chamber 49, so that the refrigerant gas having been compressed to high temperature and pressure by the procedure described below is discharged to the outside of the compressor 1.

In the high stage-side scroll type compression mechanism 4, the refrigerant gas compressed to the intermediate pressure by the low stage-side rotary type compression mechanism 3 and discharged into the hermetic housing 2 is sucked into the paired compression chambers 45 through a suction opening 52. The paired compression chambers 45 are moved to the center side while the volume thereof is decreased by the revolution of the orbiting scroll 44, and join together to form one compression chamber 45. During this time, the refrigerant gas is compressed from the intermediate pressure to a high pressure (discharge pressure), and is discharged into the discharge chamber 49 through a discharge port 53 formed in the central part of the fixed scroll 43. This high temperature and pressure refrigerant gas is discharged to the outside of the compressor 1 via the discharge pipe 51.

Figure 3:
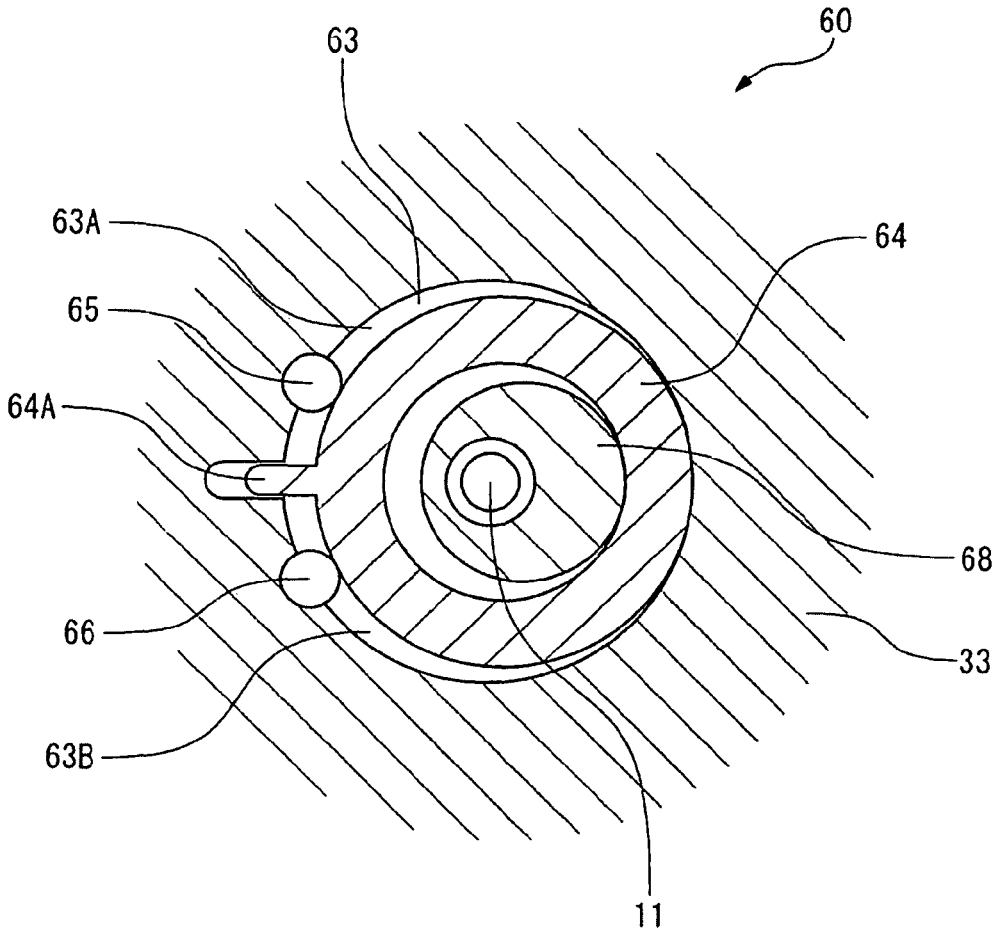
FIG. 3 is a transverse sectional view of a positive displacement lubrication pump.

As shown in FIG. 3, the positive displacement lubrication pump 60 forms a cylinder chamber 63, the lower open part of which is closed, in the lower bearing 33 forming the low stage-side rotary type compression mechanism 3 by a thrust plate 61 and a cover plate 62. In the cylinder chamber 63, a rotor 64 fitted to an eccentric shaft 68 formed at the lower end of the crankshaft 24 and revolved while being in contact with the inner peripheral surface of the cylinder chamber 63 is disposed. The rotor 64 is integrally provided with a blade 64A for partitioning the interior of the cylinder chamber 63 into an oil supply chamber 63A and an oil exhaust chamber 63B. By this positive displacement lubrication pump 60, the lubricating oil 27 stored in the lower part of the hermetic housing 2 is sucked into the oil supply chamber 63A through a suction opening 65, and discharged from the oil exhaust chamber 63B to a discharge opening 66 and fed to the oil feeding hole 11 through a communication path 67.

The operation of the compressor 1 constructed as described above is explained.

In the low stage-side rotary type compression mechanism 3, a refrigerant gas having a low pressure is sucked into the cylinder chamber 31 from the accumulator, not shown, via the suction pipe 37. This refrigerant gas is compressed to the intermediate pressure by the rotation of the rotor 34 made via the electric motor 21 and the crankshaft 25, and then is discharged into the discharge cavity 35. The refrigerant gas is further discharged from the discharge cavity 35 into the hermetic housing 2 through the discharge opening provided in the discharge cover 36. Thereby, the interior of the hermetic housing 2 is made to have an intermediate-pressure atmosphere, and therefore the electric motor 21 and the lubricating oil 27 are made to have a temperature equivalent to that of the intermediate-pressure refrigerant gas.

The above-mentioned intermediate-pressure refrigerant gas is sucked into the compression chambers 45 of the high stage-side scroll type compression mechanism 4 through the suction opening 52 that is open to the hermetic housing 2. In the high stage-side scroll type compression mechanism 4, the electric motor 21 is driven, and thereby the orbiting scroll 44 is revolved with respect to the fixed scroll 43 via the crankshaft 26, the crank part 26A, and the drive bush 46, by which the refrigerant gas is compressed. Thereby, the intermediate-pressure refrigerant gas is compressed to a high-pressure state, and is discharged into the discharge chamber 49 through the discharge valve 48.

The high temperature and pressure refrigerant gas discharged into the discharge chamber 49 is discharged from the compressor 1 through the discharge pipe 51 connected to the discharge chamber 49.

While the above-described operation is performed, the lubricating oil 27 stored in the bottom part of the hermetic housing 2 is fed to the predetermined lubrication locations of the low stage-side rotary type compression mechanism 3 and the high stage-side scroll type compression mechanism 4 via the oil feeding hole 11 by the positive displacement lubrication pump 60, so that the low stage-side rotary type compression mechanism 3 and the high stage-side scroll type compression mechanism 4 can be lubricated surely. Specifically, the lubricating oil 27 in the hermetic housing 2 is sucked into the oil supply chamber 63A through the suction opening 65, being discharged from the oil exhaust chamber 63B to the discharge opening 66 by the revolution of the rotor 64, and is sent out to the oil feeding hole 11 via the communication path 67. By this lubricating operation of the positive displacement lubrication pump 60, even the high stage-side scroll type compression mechanism 4, for which differential pressure lubrication is difficult to do, can be lubricated surely.

As described above, in the compressor 1, the positions of the oil exhaust hole 42H formed in the high stage-side scroll type compression mechanism 4, the cut part 22C, and the blade 38 in the low stage-side rotary type compression mechanism 3 coincide with each other in the vertical direction. Therefore, the lubricating oil 27 supplied to the high stage-side scroll type compression mechanism 4 is collected in the concave part of the bearing 40, and then is exhausted through the oil exhaust hole 42H. Thereafter, the lubricating oil passes through the cut part 22C while dropping freely, and is fed toward the blade 38 in the low stage-side rotary type compression mechanism 3. Therefore, by controlling the rotational speed of the compressor 1 by an inverter and by using $CO_2$ as the refrigerant gas, the lubrication between the blade 38 and the cylinder body 31 is secured even if the oil level of the lubricating oil 27 is lower than the position of the cylinder body 31 of the low stage-side rotary type compression mechanism 3. For this reason, the mechanical efficiency is not decreased by the friction between the blade 38 and the cylinder body 31 (groove), and also the reliability of the compressor 1 is not decreased by the friction. Further, since the refrigerant gas is prevented from flowing in between the suction chambers or the compression chambers from the back surface of the blade 38, the compression efficiency can be prevented from decreasing.

The compressor 1 is configured so that the arrangement portions of the oil exhaust hole 42H, the cut part 22C, and the blade 38 in the low stage-side rotary type compression mechanism 3 coincide with each other in the vertical direction. Therefore, the oil feeding path of the lubricating oil 27 from the oil exhaust hole 42H to the blade 38 in the low stage-side rotary type compression mechanism 3 is the shortest. Thereby, the time of contact with the refrigerant gas can be shortened, which is effective in restraining the dissolution of the lubricating oil 27 in the refrigerant gas. Also, for the compressor 1, a guide for guiding the lubricating oil 27 supplied to the high stage-side scroll type compression mechanism 4 to the arrangement portion of the blade 38 need not be provided separately, so that the construction of the compressor 1 need not be complicated.

However, the present invention embraces a mode in which the lubricating oil 27 supplied to the high stage-side scroll type compression mechanism 4 is fed toward the blade 38 by providing the guide even if the positions of the oil exhaust hole 42H, the cut part 22C, and the blade 38 in the low stage-side rotary type compression mechanism 3 do not coincide with each other in the vertical direction.

The phrase of "toward the blade 38" includes a case where the lubricating oil 27 reaches the blade 38 as the result of being fed to the vicinity of the blade 38 besides being fed directly to the blade 38. For example, in the case where the lubricating oil 27 is fed to the broached hole 39H, the lubricating oil 27 is sucked from the cylinder chamber 31 side on which the lubricating oil 27 is at a low pressure, and resultantly the lubricating oil 27 reaches the blade 38. In this case, even if the feed amount of the lubricating oil 27 is too large, the excess lubricating oil 27 returns to the bottom part of the hermetic housing 2 passing through the broached hole 39H. Therefore, an increase in oil circulation rate (the quantity of oil circulating together with the refrigerant gas, OCR) caused by the raised excess lubricating oil 27 can be prevented.

Second Embodiment

Figure 4:
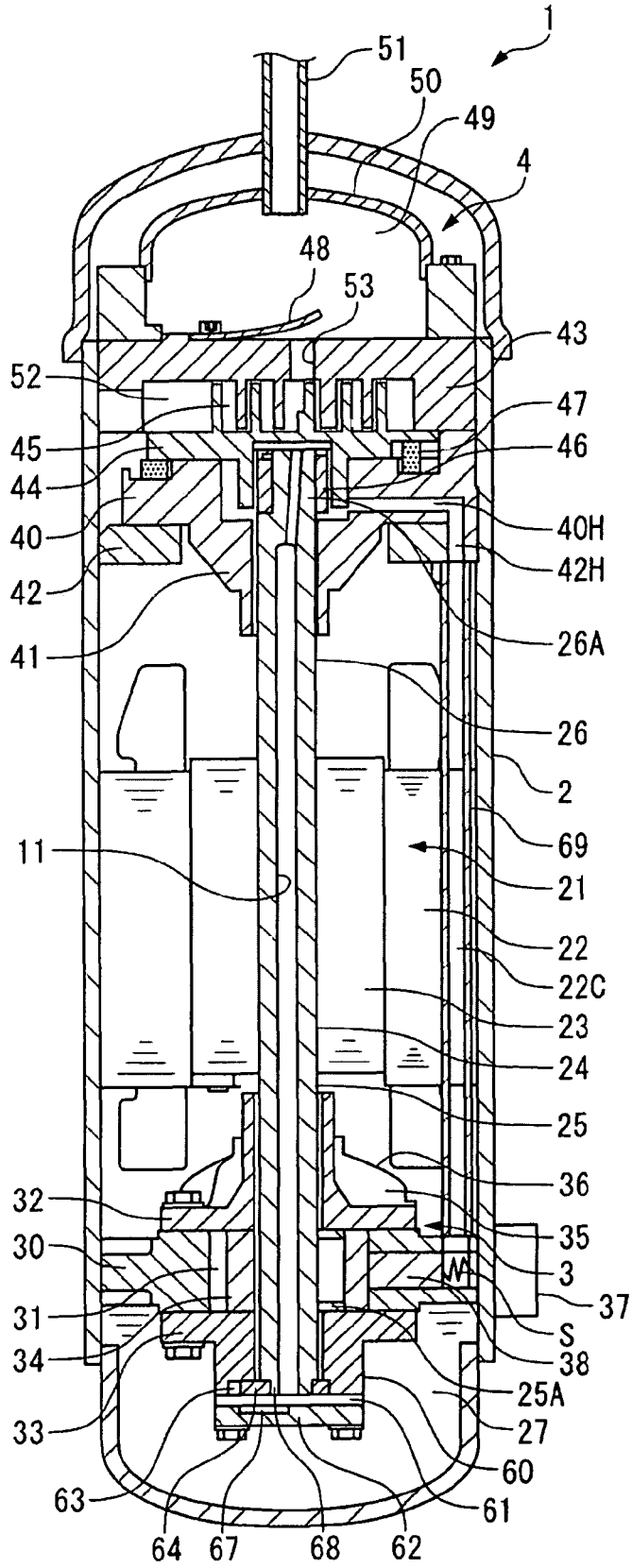
FIG. 4 is a sectional view showing a construction of another compressor to which the present invention is applied.

Next, a second embodiment of the present invention is explained with reference to FIG. 4.

In the second embodiment, a tube body 69 is provided in the path for feeding the lubricating oil 27, which is exhausted from the oil exhaust hole 40H and the oil exhaust hole 42H, toward the blade 38. Since the lubricating oil 27 exhausted from the oil exhaust hole 40H and the oil exhaust hole 42H passes through the interior of the tube body 69, the contact of the lubricating oil 27 with the refrigerant gas in the hermetic housing 2 is reduced. If $CO_2$ is used as the refrigerant gas as described above, the dissolution amount of the lubricating oil 27 in the refrigerant gas ($CO_2$) increases, so that the OCR increases. Therefore, the compressor in accordance with the second embodiment, in which the tube body 69 is provided, is effective in reducing the OCR in the case where $CO_2$ is used as the refrigerant gas.

Although the tube body 69 is used in this embodiment, any member such as a trough-shaped member or a plate-shaped member may be used if the member has a function for restraining the contact of the lubricating oil 27 with the refrigerant gas.

Third Embodiment

Figure 5:
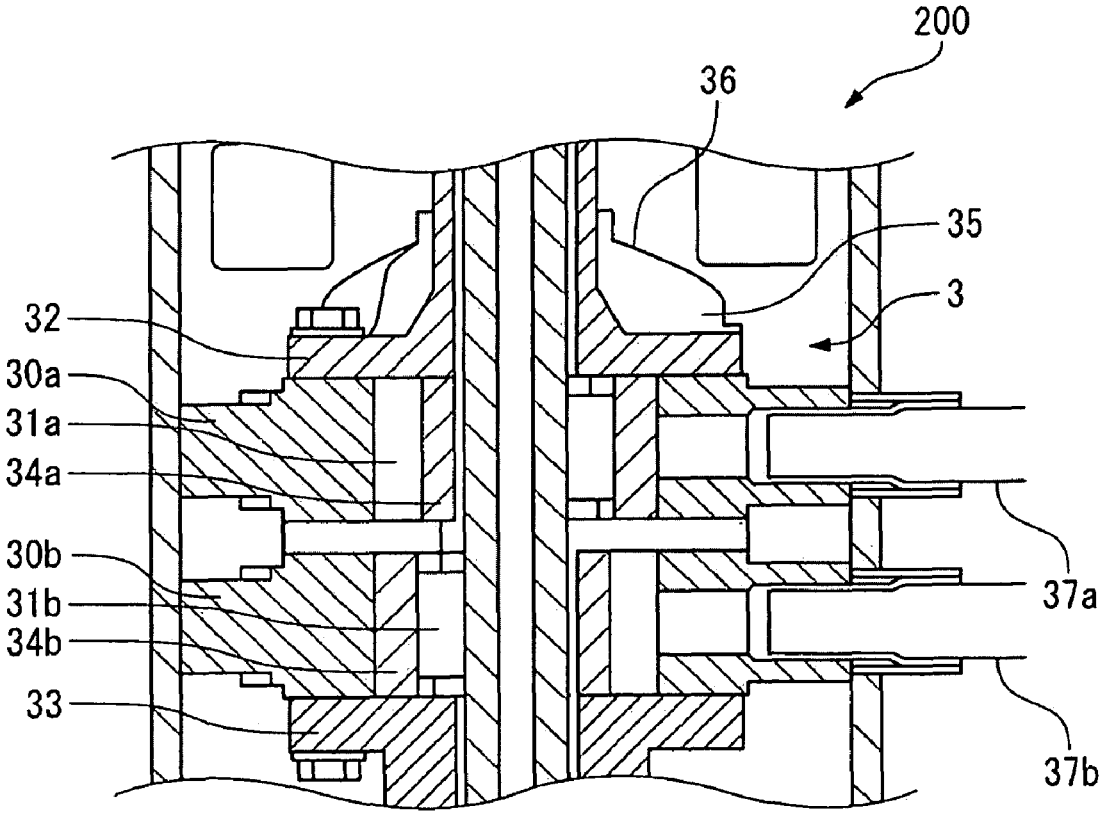
FIG. 5 is a sectional view showing a twin rotary type compression mechanism.
Figure 6:
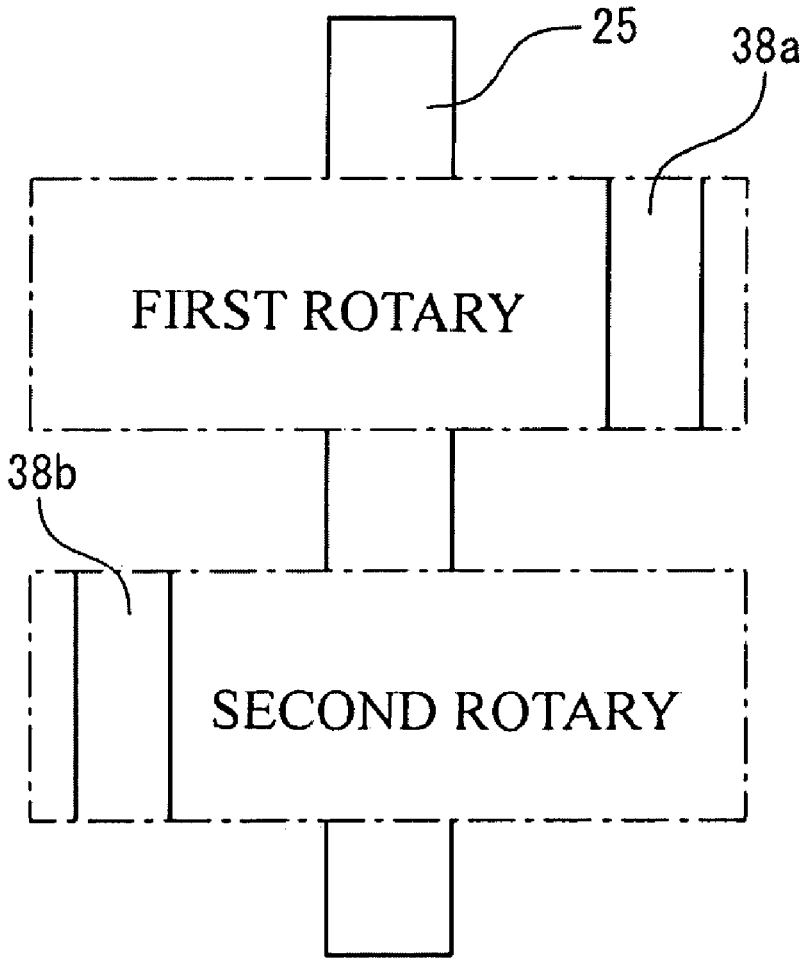
FIG. 6 is a schematic view showing an arrangement example of blades of a twin rotary type compression mechanism.

As the compressor 1 shown in FIG. 1, an example in which the rotary type compression mechanism has a single cylinder (single rotary) has been shown. However, the present invention can be applied to a compressor 200, in which the rotary type compression mechanism is configured so as to have two cylinders (twin rotary) as shown in FIG. 5 and other portions are configured in the same manner as those of the compressor 1 shown in FIG. 1. The twin rotary is provided with two cylinder bodies 30*a* and 30*b*, and the cylinder body 30*a* has a cylinder chamber 31*a* and the cylinder body 30*b* has a cylinder chamber 31*b*. In the cylinder chamber 31*a*, a rotor 34*a* is disposed, and in the cylinder chamber 31*b*, a rotor 34*b* is disposed. The refrigerant gas sucked into the cylinder chambers 31*a* and 31*b* via suction pipes 37*a* and 37*b* connected to the accumulator, respectively, is compressed by the rotations of the rotors 34*a* and 34*b*. A mechanism in which the cylinder body 30*a* is an element is referred to as a first rotary, and a mechanism in which the cylinder body 30*b* is an element is referred to as a second rotary. The same symbols as those in FIG. 1 denote the same elements as those of the compressor 1 shown in FIG. 1. In this embodiment, as shown in FIG. 6, a blade 38*a* of the first rotary and a blade 38*b* of the second rotary are sometimes arranged with the crankshaft 25 being held therebetween.

In the case of the compressor 200 provided with the above-mentioned twin rotary, the lubricating oil 27 exhausted from the oil exhaust hole 42H is fed to the first rotary positioned on the upper stage side.

For the second rotary positioned on the lower stage side, it is relatively easy to control the oil level thereof so that the second rotary is immersed in the lubricating oil 27. Even in the case where the rotational speed of the compressor 200 is controlled by the inverter, and $CO_2$ is used as the refrigerant gas, the blade 38*b* of the second rotary can be lubricated properly. Contrarily, for the first rotary arranged on the upper stage side, there is a fear that the blade 38*a* cannot be lubricated due to the changes in oil level of the lubricating oil 27. Therefore, the lubricating oil 27 exhausted from the oil exhaust hole 42H is fed to the blade 38*a* of the first rotary positioned on the upper stage side.

In this case, even if the lubricating oil 27 exhausted from the oil exhaust hole 40H and the oil exhaust hole 42H is fed to the blade 38*a* of the first rotary on the upper stage side, it is difficult to feed the lubricating oil 27 to the blade 38*b* of the second rotary on the lower stage side. Therefore, this embodiment in which the lubricating oil 27 exhausted from the oil exhaust hole 40H and the oil exhaust hole 42H is fed to the blade 38*a* of the first rotary on the upper stage side is especially effective for the compressor 200 in which the blade 38*a* of the first rotary and the blade 38*b* of the second rotary are arranged with the crankshaft 25 being held therebetween.

The above is an explanation of the embodiments of the present invention. The present invention is not limited to the above-described embodiments, and changes can be made appropriately without departing from the spirit and scope of the present invention.

What is claimed is:

1. A compressor comprising:

a hermetic housing in which lubricating oil is stored in the bottom part thereof;

a low stage-side rotary type compression mechanism provided in the hermetic housing and having a rotor, and a cylinder for holding a blade reciprocating with the rotation of the rotor while the tip end thereof is in contact with the rotor;

a high stage-side scroll type compression mechanism provided in the hermetic housing to suck and compress refrigerant gas compressed by the low stage-side rotary type compression mechanism;

a drive shaft connecting the low stage-side rotary type compression mechanism and the high stage-side scroll type compression mechanism to each other and having an oil feeding hole in the axial direction;

an electric motor for driving the low stage-side rotary type compression mechanism and the high stage-side scroll type compression mechanism via the drive shaft;

a lubrication pump for feeding the lubricating oil to the high stage-side scroll type compression mechanism via the oil feeding hole; and an oil feeding path for feeding the lubricating oil, which is fed to the high stage-side scroll type compression mechanism, is dripped toward the blade of the low stage-side rotary type compression mechanism.

2. The compressor according to claim 1, wherein the oil feeding path is configured so that the lubricating oil drops freely and is fed toward the blade.

3. The compressor according to claim 1, wherein the oil feeding path is configured so that the lubricating oil is fed toward a penetrating hole formed in the cylinder so as to house an elastic body for pressing the blade toward the rotor and to penetrate in the rotation axis direction of the rotor.

4. The compressor according to claim 1, wherein the oil feeding path has a shield for restraining the contact of the lubricating oil flowing in the oil feeding path with the refrigerant gas existing in the hermetic housing.

5. The compressor according to claim 4, wherein the shield is a tube body.

6. The compressor according to claim 1, wherein the low stage-side rotary type compression mechanism is formed by a first rotary type compression mechanism positioned on the upper side and a second rotary type compression mechanism positioned on the lower side of the first rotary type compression mechanism; and the oil feeding path is configured so as to feed the lubricating oil, which is fed to the high stage-side scroll type compression mechanism, toward a blade of the first rotary type compression mechanism.

7. The compressor according to claim 1, wherein the refrigerant gas is carbon dioxide ($CO_2$).

8. The compressor according to claim 1, wherein:

an oil exhaust hole is formed in the high stage-side scroll type compression mechanism;

the electric motor includes a stator and a rotor;

in the outer peripheral surface of the stator, cut parts are formed;

in positions in which the cut parts are formed, spaces are formed between the stator and the hermetic housing;

the oil exhaust hole, the cut parts and the blade in the low stage-side rotary type compression mechanism are arranged side by side in the vertical direction; and the oil exhaust hole and the cut part partly form the oil feeding path.

* * * * *